US005789715A

United States Patent [19]

Kakko et al.

[11] Patent Number: 5,789,715

[45] Date of Patent: Aug. 4, 1998

[54] WAITING TIME DISPLAY FOR AN ELEVATOR

[75] Inventors: Markku Kakko; Tapio Tyni, both of Hyvinkää, Finland

[73] Assignee: Kone Oy, Helsinki, Finland

[21] Appl. No.: 502,295

[22] Filed: Jul. 13, 1995

[30] Foreign Application Priority Data

Jul. 13, 1994 [FI] Finland ..... 943331

[51] Int. Cl.[6] ..... B66B 3/02

[52] U.S. Cl. ..... 187/397; 187/393

[58] Field of Search ..... 187/393, 394, 187/391, 397, 398, 399

[56] References Cited

U.S. PATENT DOCUMENTS

| | | | |
|---|---|---|---|
| 4,709,788 | 12/1987 | Harada | 187/124 |
| 4,719,996 | 1/1988 | Tsuji | 187/127 |
| 4,724,933 | 2/1988 | Tsuji et al. | 187/124 |
| 4,760,896 | 8/1988 | Yamaguchi | 187/124 |
| 4,852,696 | 8/1989 | Fukuda et al. | 187/139 |
| 4,995,479 | 2/1991 | Fujiwara et al. | 187/135 |
| 5,018,604 | 5/1991 | Tanio | 187/121 |
| 5,042,620 | 8/1991 | Yoneda et al. . | |
| 5,398,783 | 3/1995 | Jacoby | 187/395 |

FOREIGN PATENT DOCUMENTS

| | | |
|---|---|---|
| 53-147354 | 12/1978 | Japan . |
| 4164788 | 6/1992 | Japan . |
| 4266372 | 9/1992 | Japan . |
| 4371472 | 12/1992 | Japan . |

*Primary Examiner*—Robert Nappi

[57] ABSTRACT

The invention relates to a waiting time display (5) on a landing. The waiting time display (5) is active from the moment when the landing call button (6) is pressed to the moment when the call is reset. The waiting time display (5) receives from the group control unit (1) information about the order of magnitude of the waiting time and the rate of diminution of the order of magnitude of the waiting time, which is used by the waiting time display (5) to decrease the waiting time displayed.

21 Claims, 3 Drawing Sheets

WAITING TIME DISPLAY FOR AN ELEVATOR

The present invention relates to a waiting time display for an elevator.

BACKGROUND OF THE INVENTION

It is known that in elevator groups in which a landing call is definitively assigned to one of the elevators in the group, a waiting time display informing the passenger about the arrival of an elevator can be relatively easily implemented. A call allocation system that issues a landing call to an elevator at a late stage gives a better group performance but involves difficulties regarding the display of waiting time: It is possible that the group will decide at the last instant, e.g. when new landing calls appear, to send a different elevator than originally intended to serve a passenger who has issued a landing call. In this case the length of the waiting time is changed as well while the passenger is waiting.

In a group control system employing early call allocation, an elevator is reserved for a call as soon as the call button has been pressed. In such a system it is possible to inform the passenger at once as to when he/she is going to be served and by which elevator. As only new calls need to be allotted among the elevators, the amount of calculation required by them remains reasonable. On the other hand, a decision thus made cannot be altered, even if the system should later find a more suitable elevator for the call. This means a reduced efficiency of the elevator group. Therefore, these type of group control units employ prediction to minimize the waiting times. The control units accumulate information about elevator traffic in the building and use it as a basis for anticipation of new calls to be received by the system. However, anticipation can not always be successful. For this reason, many control systems reserve a possibility to transfer a call already allocated to another elevator. In this case, the system sends both the elevator originally assigned and a new, faster elevator to serve the call. In other words, two elevators may arrive to serve the same call, which is a waste of capacity.

In a group control system employing late call allocation, the calls are allotted anew among the elevators in the group each time a new landing call is registered. In other words, all floor calls are allocated anew, using the latest information about the status of the elevator system. If the actual stopping decision for a given elevator is made as late as possible, good control decisions can be made by utilizing all information available regarding the status of the group. However, due to this operating principle, the group control system may decide at the last instant, e.g. when new landing calls appear, to transfer a landing call to another elevator. In this case, a drawback is that the passenger waiting on the floor in question cannot be informed about the time when he/she is going to be served until the elevator actually starts to decelerate to stop at the floor. Some control systems use so-called advance signalling, which means that the call is definitively allocated and the stopping signalling is issued before the elevator reaches the deceleration point. On the other hand, if the definitive allocation decision is made at an early stage, there is a risk of reducing the efficiency of the elevator group because elevators which would have been better suited to serve the call cannot be taken into account after the definitive allocation decision was made. Of these main types of elevator group control, late call allocation results in a good efficiency of the group, but it is also problematic regarding the display of waiting times because the waiting time displayed may suddenly change.

SUMMARY OF THE INVENTION

The object of the present invention is to eliminate the drawbacks described above.

The advantages achieved by the invention include the following:

- late call allocation can be used in group control to achieve a good efficiency
- a waiting time display is still obtained in which the time displayed does not change suddenly
- a clear display
- waiting time classes and the rate of decrease of the waiting time can be adjusted to fit the building and the capacity of the elevator group
- suited for general use
- provides an excellent opportunity to utilize the technology of intelligent buttons and displays.

BRIEF DESCRIPTION OF THE DRAWINGS

In the following, the invention is described by the aid of an example by referring to the attached drawings, in which.

DETAILED DESCRIPTION OF THE PREFERRED EMBODIMENTS

Figure 1:
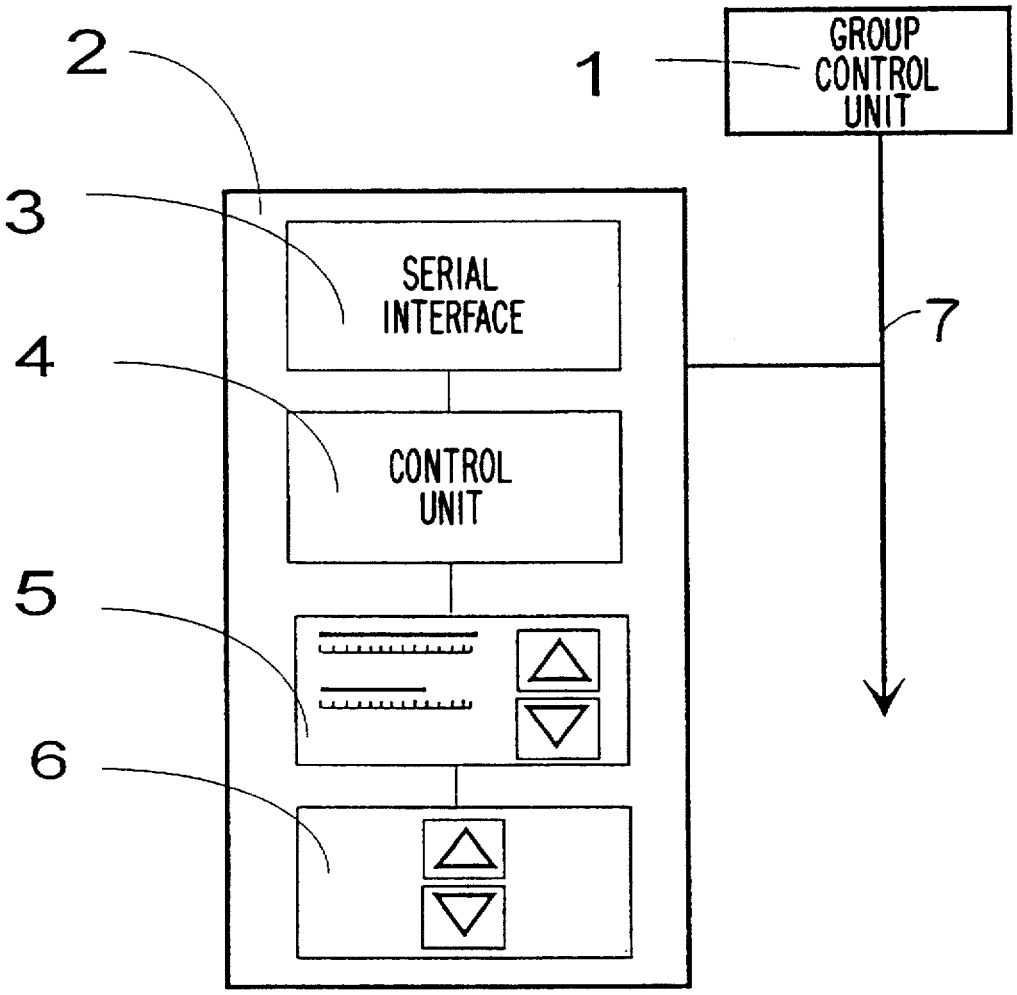
FIG. 1 presents the system of the invention in the form of a block diagram.
Figure 2A:
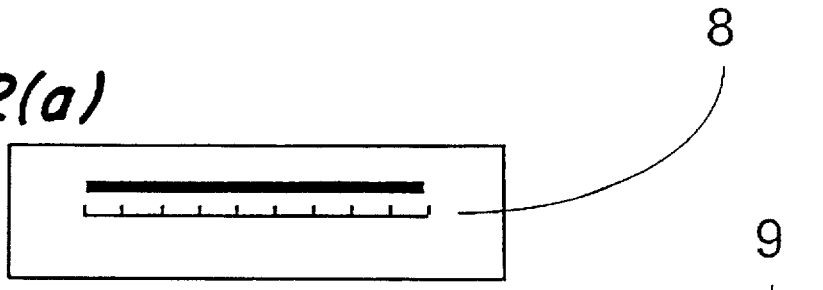
FIGS. 2*a*–2*d* presents different views of a display in which the waiting time is divided into three orders of magnitude
Figure 2B:
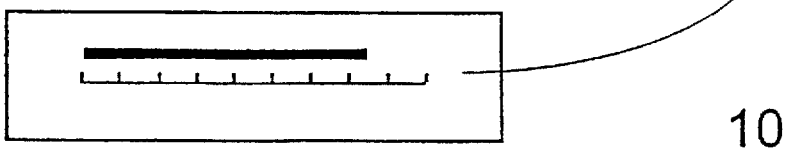
Figure 2C:
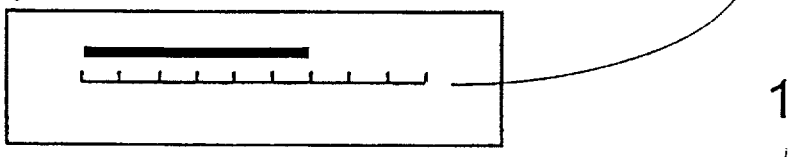
Figure 2D:
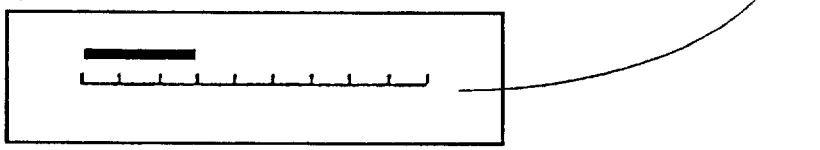

FIG. 1 shows a block diagram representing a solution of the invention to the problem of abruptly changing waiting time display 5 in a group control system 1 employing late call allocation. The solution offered by the invention includes a classification of waiting times and an intelligent waiting time display 5. The group control unit 1 is placed in a given location in the building, typically in the elevator machine room. Each floor of the building is provided with at least one landing unit 2. Connected to or comprised in the landing unit 2 are landing call buttons 6, by means of which the system is given calls from different floors. Messages are transmitted via a cable 7 between the group control system 1 and the landing units 2. In other words, several landing units 2 are connected to the cable 7, only one of which is shown in FIG. 1. The connection from each landing unit 2 to the group control unit 1 is formed via a serial interface 3. The functions of each landing unit 2 are controlled by a control unit 4. In the landing unit 2, number 5 indicates an alternative waiting time display 5 on which the waiting time is displayed in the form of a bar. The arrows indicate the travelling direction.

The waiting time display 5 on the landing is active from the moment the landing call button 6 is pressed to the moment the call is reset. The group control unit 1 controls the waiting time display 5 by means of messages. The waiting time display 5 consists of two sections, one of which shows the waiting time for an up call and the other for a down call. The waiting time display 5 is either integrated in the same unit with the landing call buttons 6 or placed separately in a different place on the landing. The waiting time display 5 may also be an independent device distinct from the landing call buttons, with its own control unit and serial interface. Upon receiving a landing call, the group control unit 1 informs the waiting time display 5 about the order of magnitude of the waiting time. The waiting time display 5 displays this order of magnitude of the waiting time in a proportional form.

In FIG. 2, the waiting time display 5 shows the waiting time by reducing it at a certain rate, decreasing the waiting time upon receipt of each new message to the next class in the diminishing direction (or down to zero). The diminution of the waiting time then stops until a new message about the next lower class is received. If an instruction to reduce the waiting time to the next lower class is received from the group control unit 1 before the diminution to the next lower waiting time class has been completed, then the waiting time transmitted by the group control unit overrides the diminution display. FIG. 2 presents a waiting time divided into three orders of magnitude. The first one (FIG. 2*a*) is a long waiting time 8, the second (FIG. 2*b*) is a case where the waiting time display 5 has decreased the waiting time after some time 9. The third one (FIG. 2*c*) is a normal waiting time 10 and the last one 11 is a short waiting time. In FIG. 2 the waiting time is displayed in the form of a bar indicating that an elevator is approaching. The waiting time display 5 can be implemented e.g. as a bar, an hour glass, a clock with hands or as a circular sector.

Figure 3:
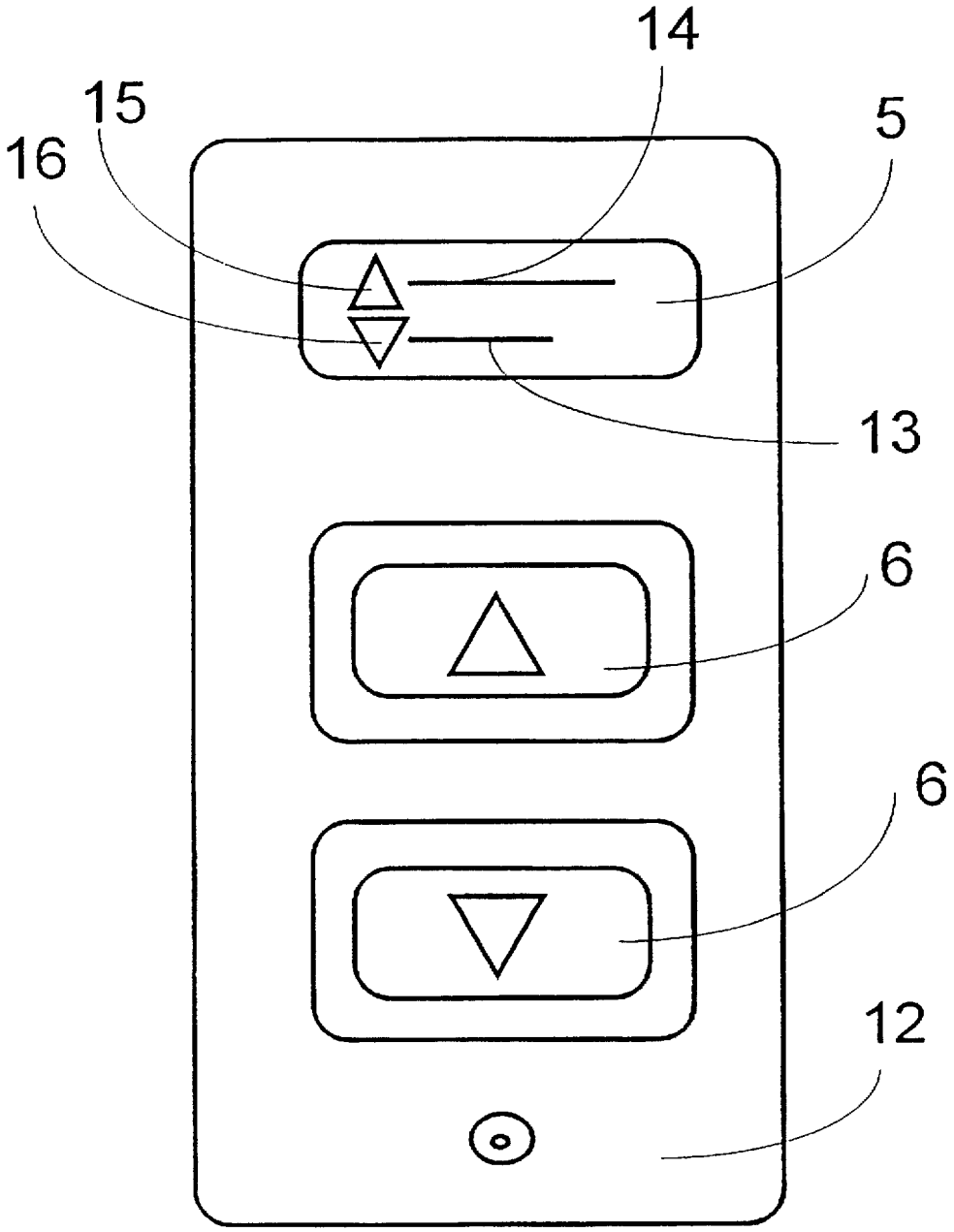
FIG. 3 presents a landing call button and a waiting time display.

FIG. 3 presents an embodiment in which the landing call buttons 6 and waiting time display 5 are placed in the same case 12 mounted on a landing. The waiting time is displayed using bars 13 and 14, the length of which indicates the time within which an elevator is to arrive. The arrows 15 and 16 indicate the direction of the landing call to be served.

The display can be controlled e.g. in the following ways:

1) In addition to the order of magnitude of the waiting time, the group control system 1 also informs the waiting time display 5 about the diminution time to be used by the waiting time display 5 to decrease the waiting time.
2) The group control unit 1 sends the waiting time display 5 information about the order of magnitude of the waiting time in the form of a proportional initial value, a proportional final value and a diminution time. For example, initial value 100%, final value 60% and diminution time 5 seconds.
3) Instead of a diminution time as mentioned above, a rate of diminution is used. For example, 3 percent a second.

The division into orders of magnitude of the waiting time, the diminution time and the rate of diminution are obtained e.g. in the following ways:

a) The division of the waiting time into orders of magnitude and the diminution time or one of them is set in advance.
b) Calculated automatically from the following information:

number of elevators, number of floors, floor height, velocity of the elevator and acceleration of the elevator.

c) Calculated automatically from waiting time information accumulated in statistical history. The waiting time display 5 is provided with a processor and a memory enabling "intelligent" functions. This is made possible by connecting the waiting time display to an intelligent landing unit 2. Information is transmitted in the form of messages via a serial communication link provided between the waiting time display 5 and the group control unit 1.

It is obvious to a person skilled in the art that different embodiments of the invention are not restricted to the examples described above, but that they may instead be varied within the scope and equivalents of the following claims.

We claim:

1. A system for displaying a waiting time at a landing for an elevator group having two or more elevators, said system comprising:

a group control unit issuing waiting time information messages;

a landing unit having a waiting time display for receiving the waiting time information messages and for displaying waiting time;

at least one landing call button, wherein said waiting time display is active from the moment when the landing call button is pressed to the moment when the call is reset, and the waiting time information messages are received by said waiting time display;

the waiting time information messages providing information about the order of magnitude of the waiting time and either the rate of diminution of the order of magnitude of the waiting time or the diminution time, said waiting time display processing the provided information to gradually decrease the displayed waiting time according to the rate of diminution or according to the diminution time, before a next time information message is received .

2. The system according to claim 1, wherein the information about the order of magnitude of the waiting time included in the waiting time information message designates an initial proportional value to be displayed.

3. The system according to claim 1, wherein the division of the waiting time into orders of magnitude and/or the diminution time is set in advance.

4. The system according to claim 1, wherein the division of the waiting time into orders of magnitude and/or the diminution time is calculated by said group control unit from the number of elevators in the group, the number of floors, floor height, velocity of the elevator and acceleration of the elevator.

5. The system according to claim 4, wherein the division of the waiting time into orders of magnitude and the diminution time are further calculated by said group control unit from waiting time information accumulated in statistical history.

6. The system according to claim 5, wherein said waiting time display contains a processor and a memory placed in said landing unit.

7. The system according to claim 6, wherein said waiting time display is connected to said group control unit via a serial communication link.

8. The system as defined in claim 1, wherein said waiting time display consists of two display parts, one of which indicates the waiting time for an up call and the other the waiting time for a down call.

9. The system as defined in claim 1, wherein the waiting time information message consists of the information about the order of magnitude of the waiting time and the rate of diminution of the order of magnitude of the waiting time.

10. The system as defined in claim 2, wherein the information about the order of magnitude of the waiting time further includes a final proportional value to be displayed at the end of the gradual decrease.

11. The system as defined in claim 10, wherein the waiting time information message includes the diminution time over which the initial proportional value is to be decreased to the final proportional value.

12. A system for displaying a waiting time at a landing for an elevator group having at least one elevator, said system comprising:

a group control unit issuing waiting time information messages;

a landing unit having a waiting time display, for receiving the waiting time information messages and for displaying waiting time;

at least one landing call button, wherein said waiting time display receives the waiting time information messages;

wherein said waiting time display processes the provided information to gradually decrease the displayed waiting time between consecutively received time information messages.

13. The system according to claim 12, wherein each waiting time information message includes information about the order of magnitude of the waiting time and either the rate of diminution of the order of magnitude of the waiting time or the diminution time.

14. The system according to claim 13, wherein the information about the order of magnitude of the waiting time included in the waiting time information message designates an initial proportional value to be displayed.

15. The system according to claim 13, wherein the division of the waiting time into orders of magnitude and/or the diminution time is set in advance.

16. The system according to claim 13, wherein the division of the waiting time into orders of magnitude and/or the diminution time is calculated by said group control unit from the number of elevators in the group, the number of floors, floor height, velocity of the elevator and acceleration of the elevator.

17. The system according to claim 16, wherein the division of the waiting time into orders of magnitude and the diminution time are further calculated by said group control unit from waiting time information accumulated in statistical history.

18. The system as defined in claim 13, wherein the information about the order of magnitude of the waiting time further includes a final proportional value to be displayed at the end of the gradual decrease.

19. The system as defined in claim 18, wherein the waiting time information message includes the diminution time over which the initial proportional value is to be decreased to the final proportional value.

20. The system as defined in claim 12, wherein said waiting time display consists of two display parts, one of which indicates the waiting time for an up call and the other the waiting time for a down call.

21. The system as defined in claim 12, wherein the waiting time information message consists of information about the order of magnitude of the waiting time and the rate of diminution of the order of magnitude of the waiting time.

* * * * *